United States Patent [19]

Carothers

[11] 3,943,677

[45] Mar. 16, 1976

[54] ROOFING PANEL SYSTEM

[75] Inventor: Paul A. Carothers, Carmichael, Calif.

[73] Assignees: Paul A. Carothers; Rodney V. Jones; Ernest H. McCoy, all of Berkeley, Calif. ; part interest to each

[22] Filed: Aug. 5, 1974

[21] Appl. No.: 494,847

Related U.S. Application Data

[63] Continuation-in-part of Ser. No. 385,992, Aug. 6, 1973, abandoned.

[52] U.S. Cl. ..... 52/309; 52/539; 52/555; 52/533

[51] Int. Cl.[2] ..... E04D 1/20; E04D 1/36

[58] Field of Search ..... 52/105, 553, 557, 518, 52/520, 555, 506, 34, 98, 100, 165, 558, 560, 533, 539, 309

[56] References Cited

UNITED STATES PATENTS

| | | | |
|---|---|---|---|
| 1,439,435 | 12/1922 | Munro | 52/553 |
| 1,545,212 | 7/1925 | Stowe | 52/520 |
| 1,872,185 | 8/1932 | Reade | 52/105 |
| 2,037,507 | 4/1936 | Fischer | 52/557 |
| 2,071,229 | 2/1937 | Heppes et al. | 52/553 |
| 2,113,644 | 4/1938 | Bollaert | 52/518 |
| 2,115,172 | 4/1938 | Kirschbraun | 52/555 |
| 2,156,566 | 5/1939 | Kirschbraun | 52/506 |
| 2,224,351 | 12/1940 | Kaye | 52/314 |
| 2,660,217 | 11/1953 | Lawson | 52/558 |
| 3,527,004 | 9/1970 | Sorensen | 52/98 |
| 3,797,179 | 3/1974 | Jackson | 52/558 |
| 3,852,934 | 12/1974 | Kirkhuff | 52/560 |

FOREIGN PATENTS OR APPLICATIONS

| | | | |
|---|---|---|---|
| 835,089 | 5/1960 | United Kingdom | 52/558 |

*Primary Examiner*—John E. Murtagh
*Assistant Examiner*—James L. Ridgill, Jr.
*Attorney, Agent, or Firm*—Bruce & McCoy

[57] ABSTRACT

A formed panel having a relatively thin headlap underlay portion and a relatively thick exposure overlay portion with water control channels and built-in assembly guides.

5 Claims, 11 Drawing Figures

ROOFING PANEL SYSTEM

This application is a continuation-in-part of application Ser. No. 385,992 filed Aug. 6, 1973, now abandoned.

BACKGROUND OF THE INVENTION

1. Field of the Invention

The present invention relates to roofing and siding panels and more particularly to a system of prefabricated formed panels which are adapted to be arranged to provide a multiple-ply sealed weather-tight surface covering.

2. Description of the Prior Art

Wood shingle, shake, and ceramic or clay tile roofing have been used as roofing for many years because if applied correctly they are moderately successful in sealing against rain. The huskness of their appearance, pleasing shadow lines and patterns give them considerable decorative appeal. However, these materials are costly and require a great deal of highly skilled labor for application. In addition, these materials are heavy, requiring strong support, and weather tightness and durability are often unsatisfactory.

Composite roofing units have been developed in a variety of forms, but they usually do not provide the decorative appearance of shingle, shake, and tile configurations. Moreover, the butt joint and shallow overlap frequently used with these units, even when combined with complicated sealing arrangements, generally are suitable for use only on steeply pitched surfaces. In addition, existing roofing products can be easily misapplied, even with normal inspection, thereby significantly decreasing their weatherproofing ability and durability. Also, with the increased use of house and commercial environment conditioning, improved insulation is required. The existing roofing products give rain and wind protection but provide almost no insulation value.

Hence, a need exists for a lightweight durable roofing system which is economical, has a variety of decorative surfaces, is easily and accurately laid on low-pitch as well as high-pitch surfaces, and which provides a major increase in insulation value over existing systems.

SUMMARY OF THE INVENTION

The present invention is a formed panel which permits a plurality thereof to be systematically assembled to provide roofing and siding surface coverings.

Such panels are molded in an elongated and generally rectangular plate configuration of a low density material and having a relatively thick overlay exposure portion adjacent the butt end and a relatively thin underlay headlap portion adjacent the head end. The panel is tapered in thickness from the butt end of its exposure portion to the head end of the headlap portion and the width of the headlap portion is greater than the width of the exposure portion in overlap. A rigid ornamental configuration is formed on the exposure portion of said panel, and a shoulder is formed at the head end of the exposure portion at the junction with the headlap portion.

A plurality of water control grooves are provided in the panel and these include a plurality of grooves extending from the shoulder to the butt end of said exposure portion. A second plurality of grooves is formed in the top surface of the headlap portion of the panel with each disposed to run from an intermediate terminus on the headlap portion to the shoulder whereby water runs down the roof panel and then is distributed along said shoulder and further runs down the panel through the grooves in the exposure portion.

OBJECTS OF THE INVENTION

It is therefore an important object of the present invention to provide economical roofing and siding panels which are inexpensive to manufacture through utilization of mass production manufacturing techniques and materials.

Another object of the invention is to provide roofing and siding panels which are self-aligning and can be simply and accurately assembled to provide weather-tight roofing and siding systems by a lower skill of labor than is required for present conventional roofing materials.

A further object of the invention is to provide roofing and siding panels which may be arranged in a double-ply sealed relation to provide weather tightness and strength even on low-pitched building surfaces, and in a partial triple-ply sealed relation to permit double nailing of each panel to assure resistance to wind damage.

Still another object of the invention is to provide roofing and siding panels which may be formed of expandable or low-density materials to provide a wide variety of low weight decorative exposure surfaces of high insulation value.

Still a further object of the invention is to provide roofing and siding panels which upon assembly as a surface covering define water control channels to improve weather tightness.

And yet another object of the present invention is to provide a roofing panel which covers a relatively large surface area for each unit layed thereby simplifying installation and reducing labor costs.

And yet a further object of the present invention is to provide roofing and siding panels which insure accurate assembly by providing alignment stops and cutting guides, whereby upon visual inspection any flaws in application will become immediately obvious.

Other features and advantages are inherent in the invention claimed and disclosed or will become apparent to those skilled in the art from the following detailed description of the preferred embodiment when taken in conjunction with the accompanying drawings.

DESCRIPTION OF THE PREFERRED EMBODIMENT

Figure 1:
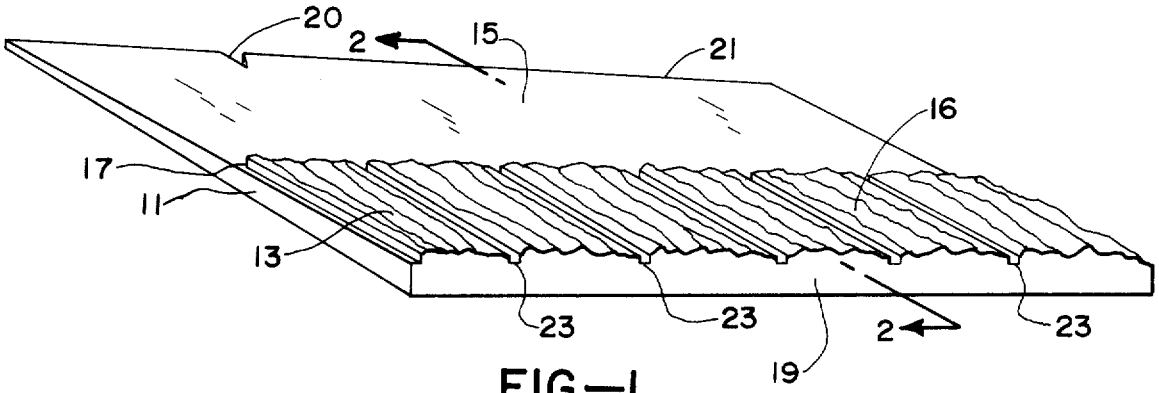
FIG. 1 is a perspective view of a roofing and siding panel constructed in accordance with an embodiment of the present invention.

The basic configuration of the roofing and siding panels of the invention is illustrated by a preferred embodiment shown in FIG. 1 of the drawings. Panel 11 has a generally rectangular plate configuration in which the major dimension, length, extends horizontally. (FIG. 3) The embodiment is constructed with a generally rectangular relatively thick lower overlay exposure portion 13 and a generally rectangular relatively thinner upper underlay headlap protion 15. The exposure portion has formed on the surface thereof a ridged configuration 16 simulating a wooden split shake shingle surface. The ridged surface 16 has a plurality of randomly spaced vertical accent grooves 23 formed therein which simulate the spaces between shakes on a shake roof. The grooves 23 appear to be randomly spaced but are accurately positioned so that adjacent courses of panels will not have aligned grooves 23.

The juncture between panel portions 13 and 15 is defined by a sharply projecting ridge or shoulder 17 which is the upper edge of the exposure portion 13 and serves as a vertical alignment stop during installation and as a water flow control as described more fully hereinafter.

The panel portions 13 and 15 generally taper in thickness from the lower relatively thick butt end 19 of exposure protion 13 to the upper thinner head end 21 of headlap portion 15 with the thickness changing abruptly at shoulder 17. However, the exposure portion 13 of the panel may have a uniform thickness to provide a particular decorative effect, such as tile, if desired. The width of the headlap portion 15 from head end 21 to shoulder 17 is preferably made somewhat greater than that of exposure portion 13 from the butt end 19 to the shoulder 17 for reasons set forth below.

Alignment/cutting lines 31 are imprinted into the back surface of the panel. The lines 31 run vertically from head end 21 to the butt end 19 and are located one-third of the length of the panel in from each end. The lines 31 serve as a sidelap gauge during assembly of a roof or siding surface.

While a rough cut wooden shake shingle design is shown on the exposure portion of the preferred embodiment, a wide variety of other ornamental surface configurations can be similarly provided. For example: ceder shingles; cordova and ceramic tiles; light, medium, rough and super rough shakes; slate, pebbled, graveled and corrugated surfaces; and many other ornamental designs can be simulated.

The panels of the invention may be provided in varying standard lengths, and the exposure portion 13 may be provided in various widths measured from shoulder 17 to butt end 19. Headlap portion 15 is made wider than the exposure portion 13 by at least about 1½ inches and preferably at least about 2 inches, to provide the multiple-overlap feature discussed below. In the preferred embodiment, the panels are standardized at 48 inches in length and 22 inches in width with the exposure portion 13 being 10 inches from butt end 19 to shoulder 17 and 12 inches from shoulder 17 to head end 21. The thickness of the various panel portions are varied over a considerable range so as to accommodate various depth requirements imposed by the nature of the ornamental ridge configuration 16 impressed on exposure portion 13.

Figure 2:
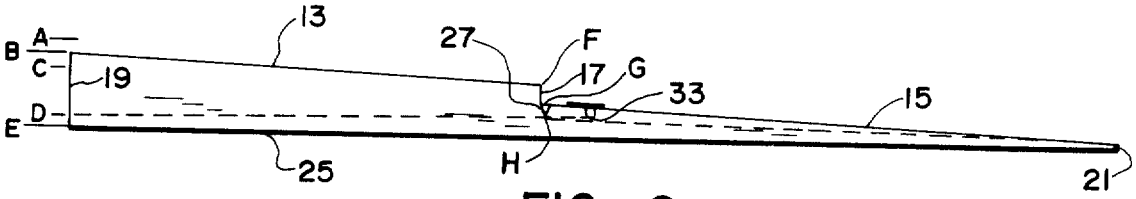
FIG. 2 is a sectional view of FIG. 1 taken along line 2—2.

Reference is made to FIG. 2 of the drawings for a more detailed illustration of a panel constructed in accordance with a preferred embodiment of the present invention. The average thickness of the butt end 19 of the panel 11 is represented by the distance from B to E but may vary in the range from E to C or A. The average thickness of the preferred embodiment E to B is approximately 1-⅜ inches, and that of the head end 21 is approximately ⅛ inches. The thickness E to D is usually about ¾ of an inch. This is from the bottom of the accent groove to the back of the panel. The accent groove is usually at least ¼ of an inch deep in the surface.

The panel is also provided with a water control system which includes a plurality of substantially parallel channels or grooves. A first set has grooves which extend from a terminus intermediate the headlap portion 15 to shoulder 17. The grooves are very shallow where they originate at their terminus near the head end 21 and get progressively deeper to approximately 3/16 inch at the lateral groove 27. Another set of grooves extends from shoulder 17 to the butt end 19 of exposure portion 13. The thickness of the panel at butt end 19 from the bottom of water control groove 23 to the underside of the panel is approximately ¼ inch, the distance from D to E, and the grooves at that point are usually in excess of ¼ inch. For added strength, a reinforcement 25 made of fiberglass or a metal mesh may be incorporated into the whole underside of the panel.

Figure 3:
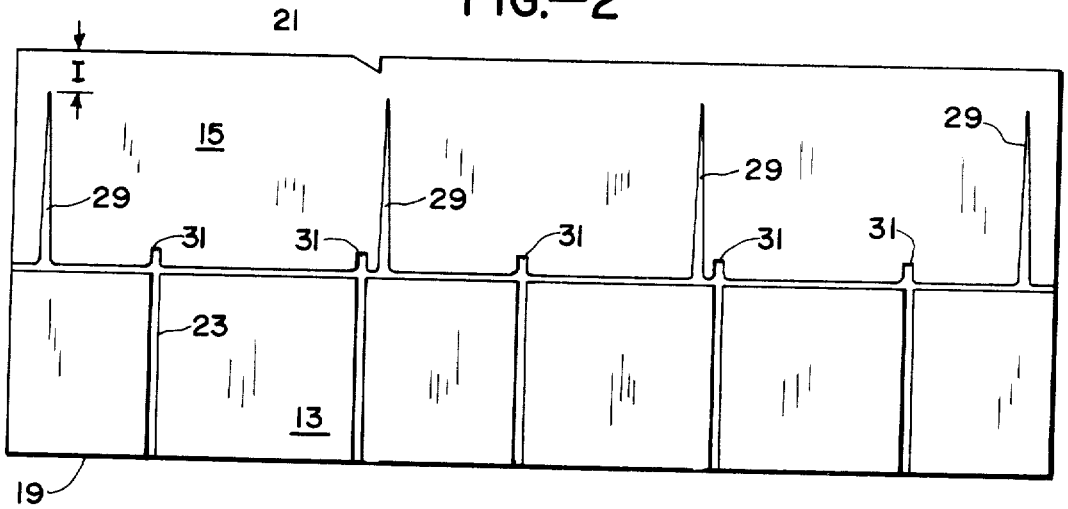
FIG. 3 is a top plan view of the panel of FIG. 1 showing the water control and self-alignment features in detail.
Figure 7:
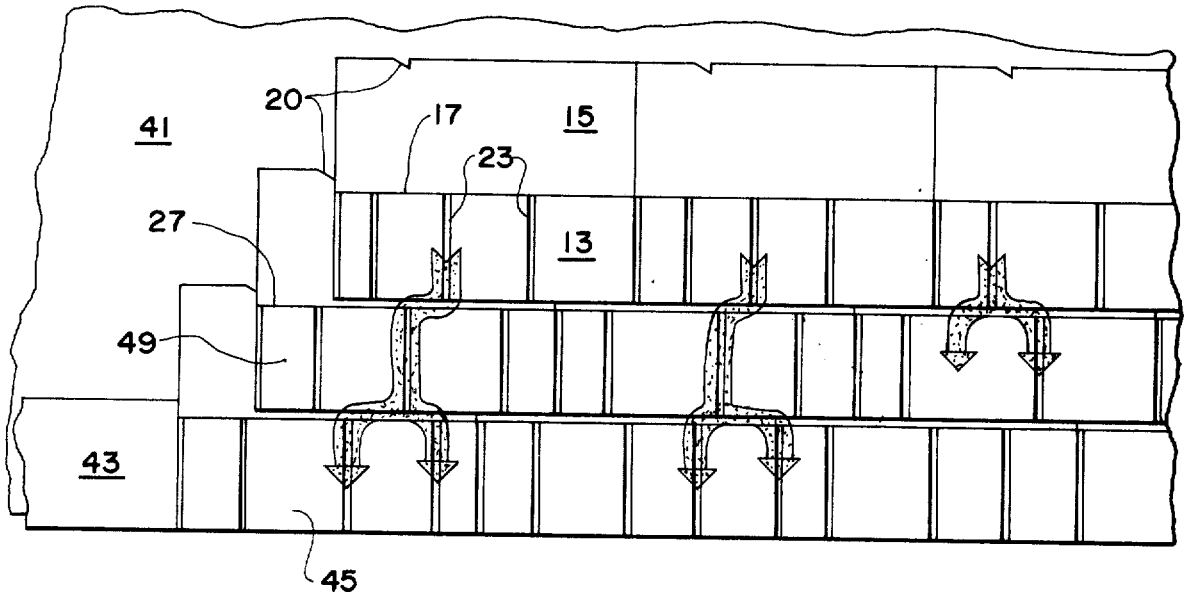
FIG. 7 is a partial plan view of an assembled roof utilizing multiple panels of FIG. 1 and diagrammatically showing examples of water drainage control thereon.
Figure 8:
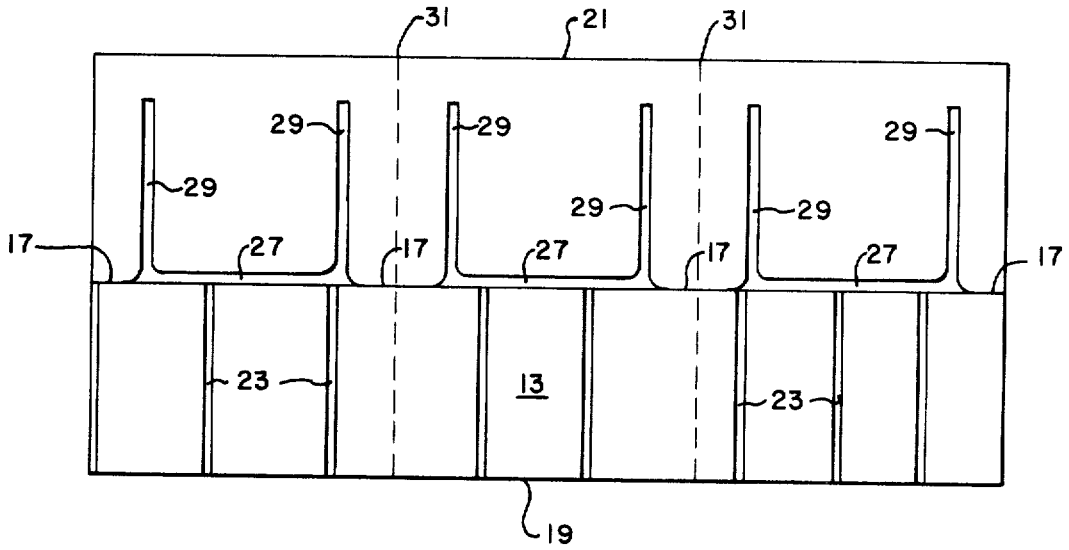
FIG. 8 is a top plan view of a further preferred embodiment of the panel of FIG. 1 showing a modified water control system.
Figure 9:
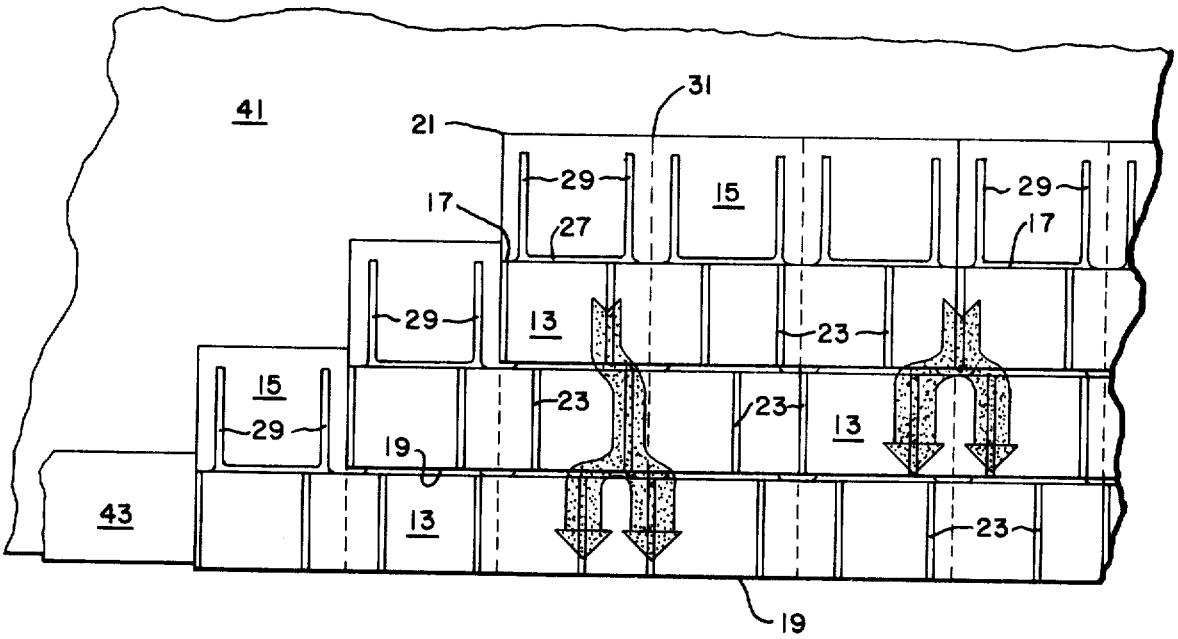
FIG. 9 is a partial plan view of an assembled roof utilizing multiple panels of FIG. 8 and diagrammatically showing examples of water drainage control thereon.

The water control channels are more readily understood when FIG. 3 is considered. The headlap water control channels 29 terminate about 2 inches from the head end 21 of the panel and 2 inches from the one-third length alignment lines 31 located on the back of the panel. Thus when assembled on a roof or siding, the abutting ends of the panels of an upper course will be disposed directly over the alignment line 31. Rainwater passing through the junction of the abutting panels will be moved outward to the control channels 29 and carried to the lateral groove 27. The water is then carried by the accent grooves 23 to the next lower course of panels. Thus by traveling down the exposure portion 13 of the water flow control channels described above, all water impinging on the roofing panel system will be conducted to the lower edge of the system. This water control feature allows installation on very low sloped or pitched roofs without special underlay provision. FIG. 7 shows this feature in more detail.

Figure 5:
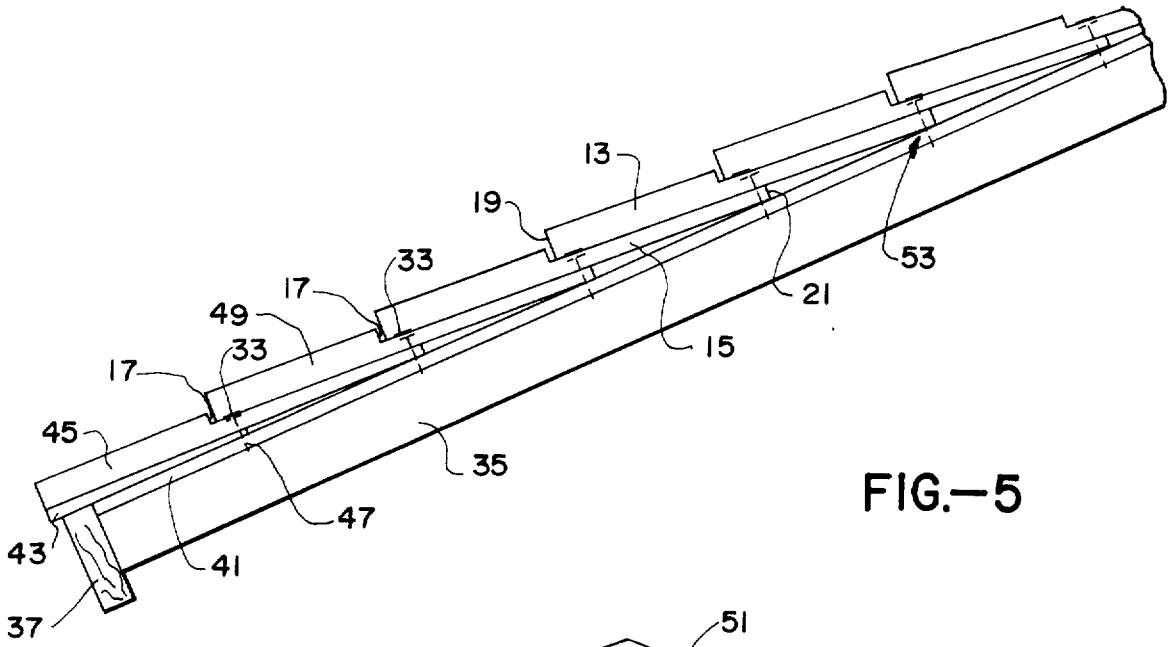
FIG. 5 is a partial vertical end view of an assembled lower roof utilizing multiple panels of FIG. 1.

The panels can either be glued to the roof surface and/or nailed thereto as shown in FIG. 5. In either case, it is preferable to use a seal 33 between the panels to secure the lower surface of the overlapping panel to the upper headlap portion of the underlapping panel. Such a seal is particularly desirable in areas where wind stability of the panels is important. A sealant applied during installation, a heat activated glue, or contact cement can be placed on the panel parallel to shoulder 17 and disposed apart therefrom on the headlap portion 15.

The panels of the invention may be fabricated by molding or coating low density thermosetting or thermoplastic rigid or semi-rigid resins and plastics, expandable plastic foams, low density fiberous concrete formulations, cellular glass or other suitable materials. For organic resin materials, densities in the range of about 2 to 5 pounds per cubic foot are generally suitable. Densities in the lower range are preferred since the cost is lower and adequate strength and excellent insulation factors are obtainable.

Preferred materials for fabricating the panels include expandable foam, cast polyurethane, polyester, phenol aldehyde, polystyrene epoxy and similar setting type organic resin foam materials in fire-resistant or fire-retardent formulations.

Foamed plastics of the type generally available do not possess notable weather resistance when exposed to sunlight. Accordingly, at least those portions of the panel exposed to sunlight upon installation and the headlap portion 15 are coated with an appropriate sunlight and weather resistant material such as chlorsulfonated polyethylene (Hypalon), polychloraprene (Neoprene), polyvinyl holugen (e.g., polyvinyl chloride) butyl rubber, silicone resin or rubber, epoxy resin, and similar weather and sunlight resistant materials either sinularly or in combination. These materials may be applied to the molds prior to casting the panels or applied to the panels after they have been formed. They may be applied by spraying, rolling or dipping. In addition to providing protection to the panels, the coatings add strength, and abrasion and fire resistance. The coatings may be colored and textured for desirable decorative effects. Cut surfaces exposed when installing a roof or siding, or damaged areas, may be covered with the coating at the site.

Figure 6:
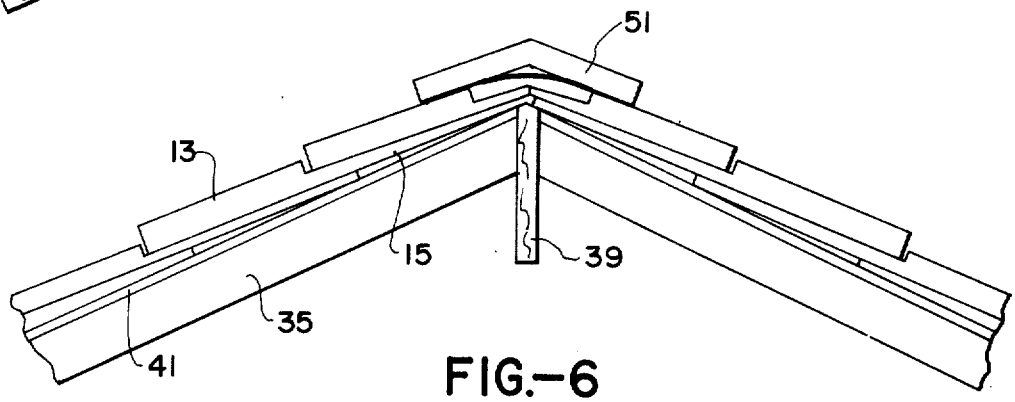
FIG. 6 is a partial vertical end view of an assembled ridge portion of a roof utilizing multiple panels of FIG. 1 and the ridge cap of FIG. 4.

The panels may be assembled to provide a roof or siding covering as shown in FIGS. 5–7 of the drawings. For example, the roof structure may include rafters 35, facia plate 37, ridge beam 39, and suitable sheathing such as plywood 41 in accordance with common practice. If desired, a vapor barrier (not shown) may also be used, the usual valley and other flashing (not shown) may be used as appropriate.

Figure 10:
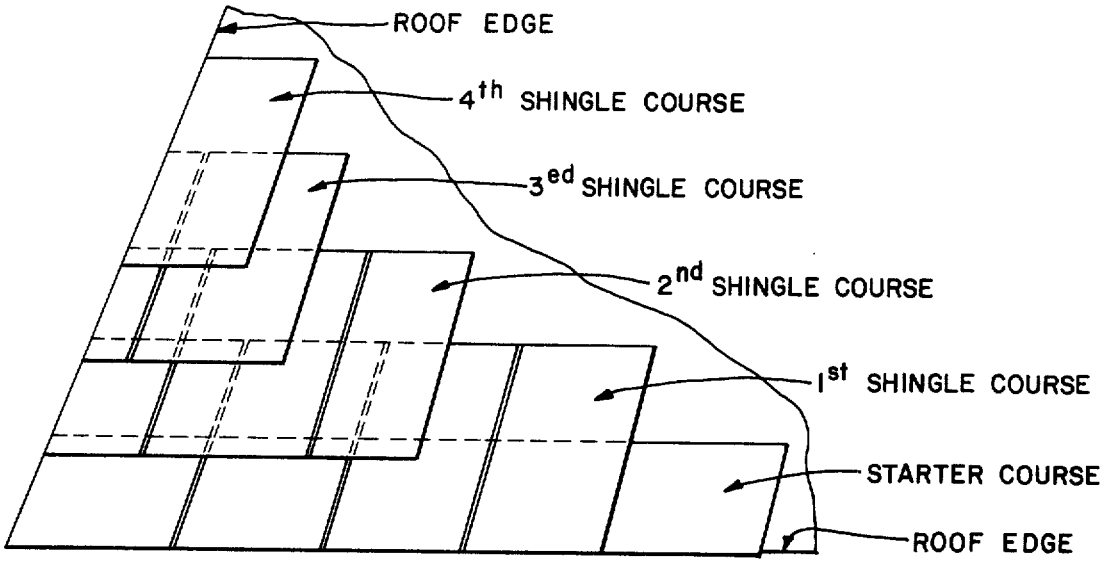
FIG. 10 illustrates the standard double coverage roof.
Figure 11:
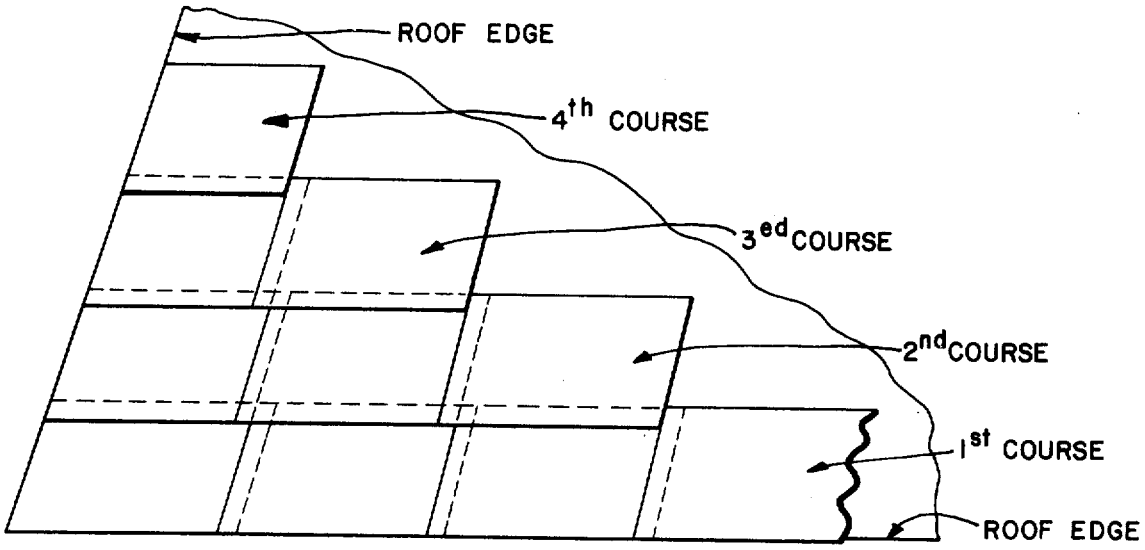
FIG. 11 illustrates the single coverage roof.

FIG. 11 illustrates a typical single coverage roof (overlap principle) with the minimum side and head laps characteristic of the system. FIG. 10 shows the preferable double coverage roof but there is only single lap coverage in the slots between the units. This is also true of 3 in 1 tabbed asphalt strip shingles.

At the outset of assembly, a starter course may be installed by nailing a row of starter panels 43 at the bottom edge of the roof at least 2 inches back from the eaves. Starter panels 43 may comprise headlap portions 15 detached from exposure poritons 13 of the panel with the cut edge sealed with an appropriate surface coating or other equivalently fabricated sections. A first row of roofing panels 45 is then applied in abutting relation over the row of starter panels 43 and fastened with nails 47 driven through roofing panel 45 above shoulder 17 in order to pierce the upper head end of starter panel 43 thereby anchoring both the roofing panel and starter panel to the wood sheathing 41. The second and successive rows of roofing panels 49, disposed in an endwise abutting relationship, are applied in a similar fashion with the butt end 19 being positioned against or uniformly spaced from the stop ridge or shoulder 17 of the preceeding course which serves as a guide to facilitate elevational positioning of the panels as they are applied.

In addition, each successive row of roofing panels may be staggered or offset with respect to the vertical or butt edges of the preceding row of panels, e.g., the left-hand edge of each successive course of panels may be horizontally positioned one-third of a panel length away to the right or left of the edges of each panel in the preceding course. This offset relation assures that the abutting joints of successive courses never coincide. Thus, the design pattern is maintained and the vertical joints between abutting panels in the same course are disposed over a solid portion of the headlap portion 15 of the preceding course, thereby controlling water flow and avoiding water leakage.

To stagger the panels as described above, the alignment/cutting line 31 may be used. For example, a one-third length panel may be made by cutting the panel on the right cutting line. By installing this one-third length panel above the first course, and on the left edge of the roof, all succeeding panels of that course will be automatically staggered one-third of a panel to the right of the panels in the first course.

Figure 4:
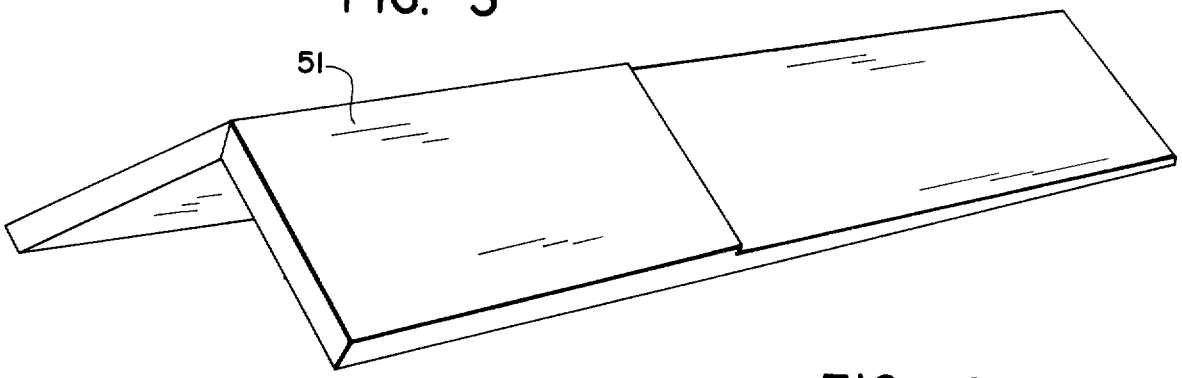
FIG. 4 is a perspective view of a ridge cap panel structure constructed in accordance with an embodiment of the present invention.

The last course of panels is terminated at the ridge line preferably by having the entire headlap portion 15 positioned thereat, but the headlap or exposure portions may be horizontally cut at any point since the ridge line 15 is capped by a ridge cap 51 in order to maintain roof appearance. The ridge cap 51 as shown in FIG. 4 is applied as shown in FIG. 6. Ridge caps may be fabricated of cut sections of the panels or they could be a prefabricated item. All cut surfaces are coated with the surface coating material to prevent sunlight degradation as described earlier. The ridge caps may be nailed into position and a sealant, glue or cement, may additionally be used as with the panels.

It will be seen that the present invention accomplishes all of the objects attributed thereto. The panels may be manufactured in relatively large sections of lightweight materials which facilitate handling and installation. A unique water flow control system combined with the long established double and triple overlap principle insure weathertight installation even on very low-pitched roofs. The alignment shoulder and cutting lines provide a method for accurate and easy installation which can be readily inspected for correctness. The relatively thick panel allows a wide variety of decorative surface effects and provides excellent insulation for energy conserving comfort.

The foregoing detailed description of the preferred embodiment has been given for clearness of understanding only and no unnecessary limitations should be understood therefrom except as may be necessitated by the appended claims since modifications will be obvious to those skilled in the art.

What is claimed is:

1. A panel for a roofing system comprising an elongated and generally rectangular panel plate molded of a low density organic resin foam material, said panel having a relatively thick overlay exposure portion adjacent the butt end and a relatively thin under lay headlap portion adjacent the head end, said panel being tapered in thickness from the butt end of its exposure portion to the head end of the headlap portion and the width of the headlap portion being greater than the width of the exposure portion in overlap, an ornamental configuration formed on the exposure portion of said panel, a shoulder formed at the head end of the exposure portion at the junction with said headlap portion, and a plurality of water control grooves including a plurality of grooves extending from said shoulder to the butt end of said exposure portion, a plurality of grooves formed in the top surface of the headlap portion of said panel with each disposed to run from an intermediate terminus on said headlap portion to said shoulder, said shoulder having a plurality of water distributing grooves disposed in said headlap portion to run laterally across said panel adjacent said shoulder interconnecting the grooves formed in said headlap portion with the grooves in said exposure portion whereby water can run down the roof panel and then be distributed along said shoulder to further run down the panel through the grooves in said exposure portion, each of said lateral grooves extending for only a portion of the width of said panel and not interconnecting and not running to the edges of said panel whereby water can flow laterally across only a portion of said panel and not to the edges of said panel thereby preventing it from flowing along said shoulder to the gaps between the panels.

2. The roofing panel of claim 1 wherein the plurality of water control grooves are generally parallel and are disposed to permit water run down the fall line of the roof and the lateral water distributing grooves are each formed to distribute water from only approximately one-fourth to one-third of the water control grooves formed in said headlap portion.

3. The roofing panel of claim 1 wherein a sunlight and weather resistant coating is disposed on at least the exposure portion of the top surface of said panel.

4. The roofing panel of claim 1 wherein cutting guide lines are embossed on the back surface of said panel parallel to the vertical edges thereof dividing said panels into uniform sections for facilitating the uniform cutting thereof.

5. A panel for a roofing system comprising an elongated and generally rectangular panel plate molded of a low density organic resin foam material including, an overlay exposure portion defined at the lower edge by the butt end, said exposure portion upper surface having an ornamental configuration, an underlay headlap portion defined at the upper edge by the head end, and being wider in overlap than said exposure portion, a shoulder formed at the junction of the two portions on the head end of the exposure portion, said panel being tapered down from its butt end to its head end in cross-section thickness, a water control system including a plurality of substantially parallel water control grooves running from a terminus intermediate the top surface of the headlap portion to the shoulder of said panel, a plurality of substantially parallel grooves extending from said shoulder to the butt end of said exposure portion, a plurality of lateral water distributing grooves formed in said headlap portion adjacent said shoulder interconnecting the grooves formed in said headlap portion with the grooves in said exposure portion, said lateral water distributing grooves not interconnecting and not running to the edges of said panel and each being formed to distribute water from only one-fourth to one-third of the water control grooves formed in said headlap portion, a sunlight and weather resistant coating disposed on at least the exposure portion of said panel to protect said low density material from deterioration, and cutting marks embossed on the back surface of said panel plates parallel to the vertical edges thereof to divide the panels into uniform sections between said lateral water distributing grooves to both facilitate the uniform cutting thereof and to provide a means for vertical alignment of adjacent panels.

* * * * *